United States Patent [19]

Cramer et al.

[11] Patent Number: 4,671,872

[45] Date of Patent: Jun. 9, 1987

[54] AERATOR MAST WITH AZIMUTH LOCK AND BOTTOM STOP

[75] Inventors: Barry G. Cramer; Roy A. Cramer, both of Kansas City, Mo.

[73] Assignee: Air-O-Lator Corporation, Kansas City, Mo.

[21] Appl. No.: 840,948

[22] Filed: Mar. 18, 1986

[51] Int. Cl.[4] ..... B01F 3/04

[52] U.S. Cl. ..... 210/219; 210/236; 210/238; 366/261; 366/285; 24/483; 248/219.1; 403/369; 403/372

[58] Field of Search ..... 403/369, 372, 373; 248/219.1, 231; 24/483; 366/261, 285, 102; 210/219, 236, 237, 238

[56] References Cited

U.S. PATENT DOCUMENTS

| | | | |
|---|---|---|---|
| 792,733 | 6/1905 | Schoenherr | 403/369 |
| 1,670,381 | 5/1928 | Rogers | 403/369 |
| 1,805,095 | 5/1931 | Horni | 403/374 |
| 2,259,460 | 10/1941 | Dexter | 24/483 |
| 3,012,750 | 12/1961 | Schermerhorn, Jr. | 248/231 |
| 3,559,941 | 2/1971 | Holzman | 248/231 |
| 3,702,200 | 11/1972 | Carman | 403/369 |
| 3,747,540 | 7/1973 | Salkoff et al. | 248/230 |
| 4,179,784 | 12/1979 | Warren et al. | 24/483 |
| 4,210,613 | 7/1980 | Webb | 261/120 |
| 4,431,597 | 2/1984 | Cramer et al. | 261/93 |
| 4,464,259 | 8/1984 | Cramer et al. | 210/219 |
| 4,514,343 | 4/1985 | Cramer et al. | 261/37 |
| 4,581,182 | 4/1986 | Cramer et al. | 366/261 |

FOREIGN PATENT DOCUMENTS

| | | | |
|---|---|---|---|
| E 8083 | 10/1956 | Fed. Rep. of Germany | 24/483 |

OTHER PUBLICATIONS

Flygt brochure.

*Primary Examiner*—Tim Miles

*Attorney, Agent, or Firm*—Litman, Day & McMahon

[57] ABSTRACT

A horizontal mixing aerator rides on a upright mast or beam for submersion in a body of liquid such as a sewage equalization basin, oxidation ditch or sludge holding tank. The aerator has a submersible mixer motor driving a propeller which is mounted to the beam by a slidable bracket arrangement for height adjustment. The bracket is also swingably mounted to the beam for adjustment of the vertical plane angle and the beam is rotatable for azimuth changes in the direction of liquid flow. A lower bracket stop includes vibration reducing elements. An upper azimuth lock also includes vibration reducing elements. The locking parts have a high coefficient of friction.

14 Claims, 8 Drawing Figures

Fig. 3.
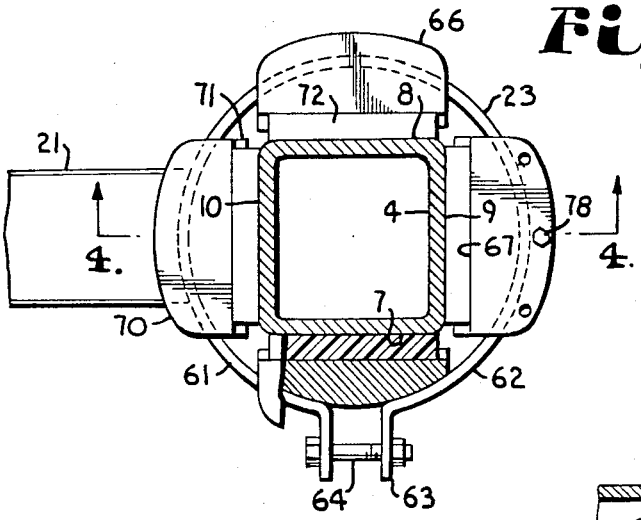
Fig. 4.
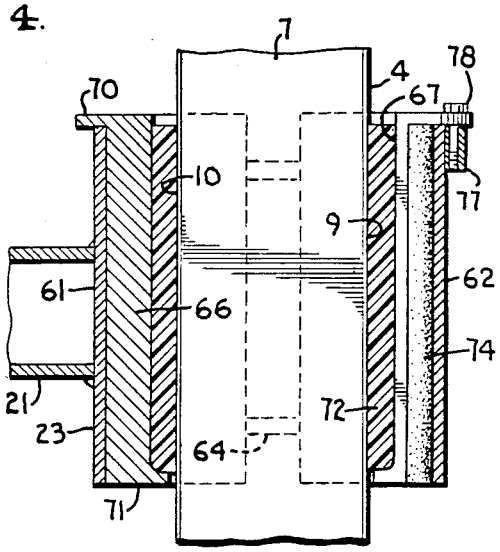
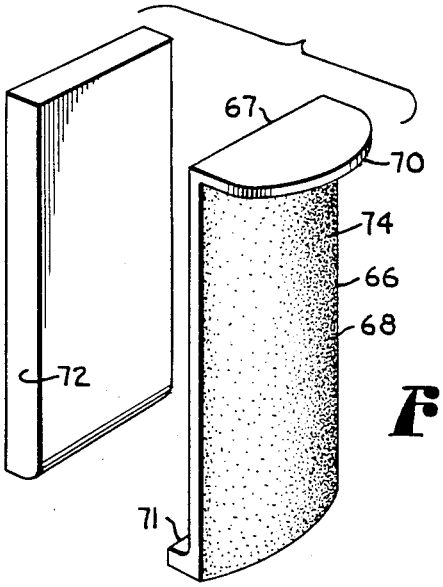
Fig. 5.
Fig. 7.
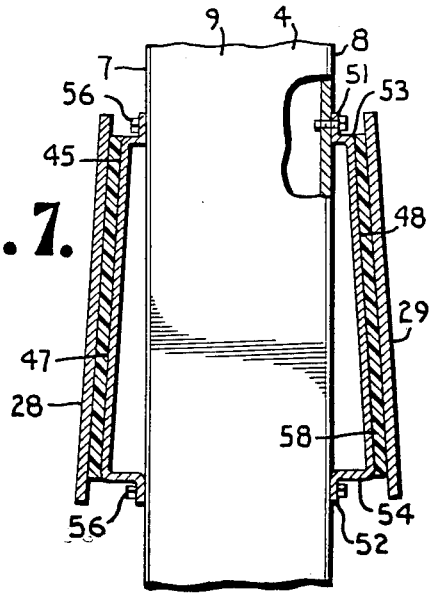
Fig. 8.
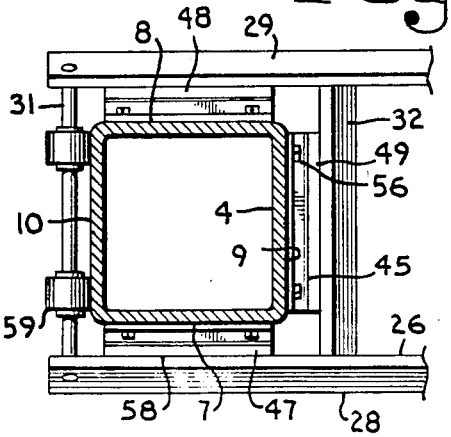

AERATOR MAST WITH AZIMUTH LOCK AND BOTTOM STOP

FIELD OF THE INVENTION

This invention relates to mixing devices in general and in particular to a mixing aerator which can be positioned within a body of liquid to direct a mixing flow as desired.

BACKGROUND OF THE INVENTION

In the mixing of large bodies of liquid, several different types of mixers have been used, such as water floats and pumps. Generally, the flotation type is not sufficiently controllable in all directions of flow for efficient mixing. Further, pumps and the like are susceptible to clogging and often do not provide sufficient rate of flow for the efficient mixing required in equalization basins, as well as oxidation ditches, sludge holding tanks and other special applications. Mixers are also used in aerated lagoons in which active biological solids are in equilibrium with supplied wastes. The basin is of sufficient depth, normally six to twelve feet, and oxygen is furnished by mechanical aeration to create a turbulence level sufficient to provide adequate liquid mixing. As a result of the mixing, uniform distribution of the wastes and dispersion of the oxygen is achieved and rapid and efficient waste bio-degradation occurs.

Various mixers mounted on masts or upright means are positioned within the body of liquid, as have been developed in recent years, such as the Flygt 4500 submersible mixer and the Air-o-lator hydraulic and electrical mast mounted units. The torque or twisting moment generated by these aerators can be quite substantial and can lead to structural failure of the mast at either the top or bottom mast supports. One means of counteracting this particular problem, as used by competitors, is to extend side braces in an attempt to hold the mast more rigid. However, these side braces, when considering the usual environment of use, tend to become encrusted with sludge and various wastes and garbage materials. In this environment, the less structure extending into the body of liquid, the better. Additionally, the ability to direct the azimuth of liquid flow is generally considered advantageous. The large torque forces from the motors used tends to twist the mast relative to the mount so that these masts become misdirected from the original set azimuth.

The present invention is directed to the bottom stop arrangement for the bracket and motor assembly relative to the mast and an improved upper azimuth lock which tends to set and hold azimuth more tenaciously than did previous structures. Both include vibration dampening materials so as to cause less material fatigue.

OBJECTS OF THE INVENTION

The principal objects of the present invention are: to provide a bottom stop and azimuth locking device; to provide a bottom stop for a vertically movable bracket and propulsion unit; to provide such a bottom stop which includes shock and vibration dampening elements; to provide such an azimuth lock which includes shock and vibration dampening elements; to provide such an azimuth lock which prevents undesired and unscheduled azimuth rotation; and to provide such a mixing aerator with bottom stop and azimuth locks which are sturdy and efficient in use and particularly well adapted for their intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is a cross-sectional view taken along lines 3—3, FIG. 2.

FIG. 4 is a cross-sectional view taken along lines 4—4, FIG. 3.

FIG. 5 is an exploded perspective view of a portion of an azimuth lock assembly.

FIG. 7 is a sectional view taken along lines 7—7, FIG. and showing parts in an engaged relationship.

FIG. 8 is a cross-sectional view taken along lines 8—8 of FIG. 2.

DETAILED DESCRIPTION OF THE PREFERRED EMBODIMENTS

Figure 2:
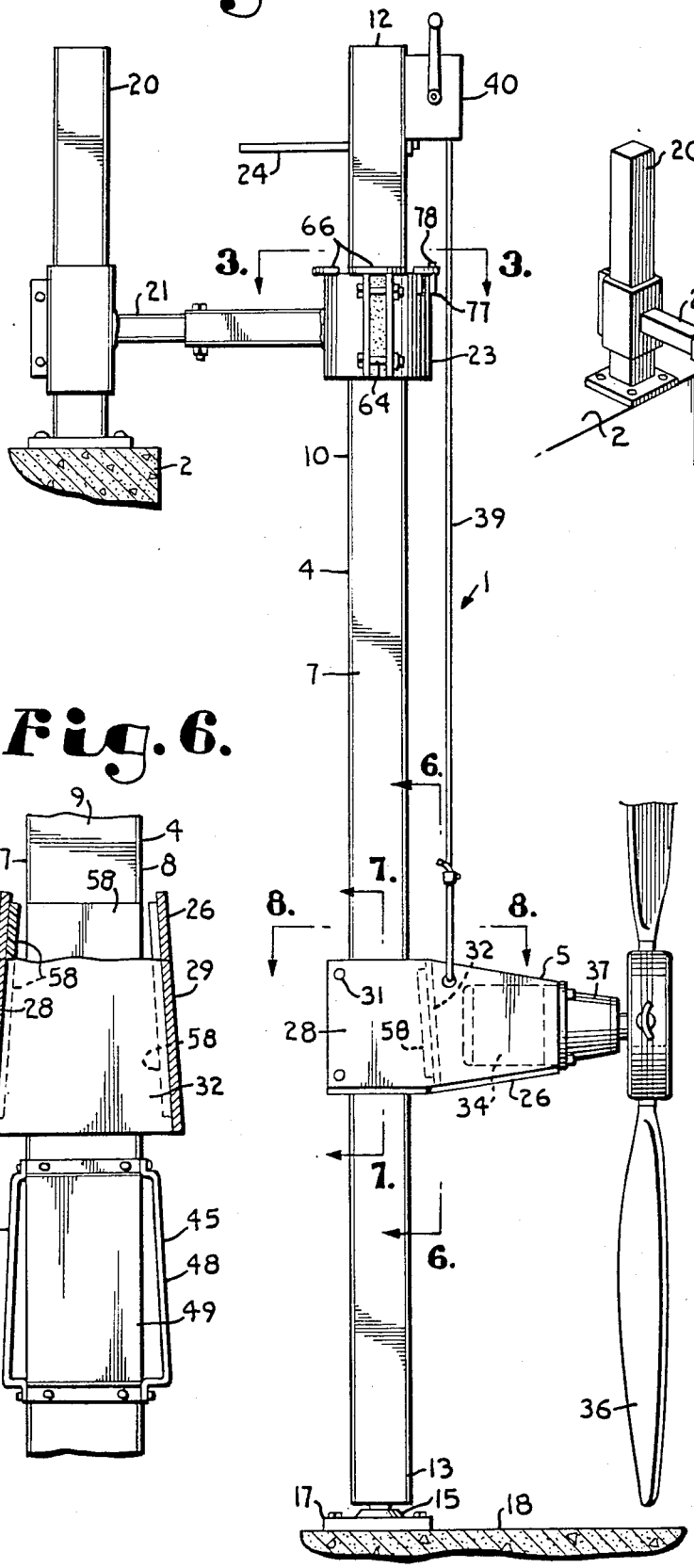
FIG. 2 is a side elevational view of the mixer unit.
Figure 1:
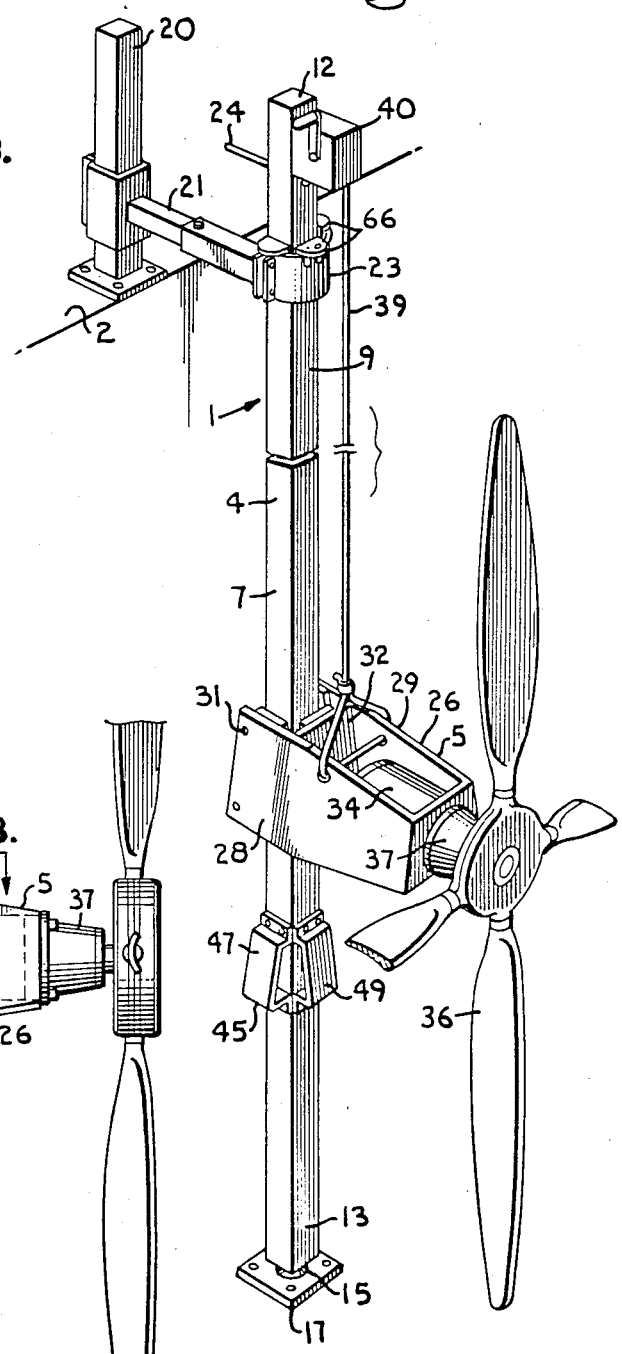
FIG. 1 is a perspective view of an aerator or mixer embodying the present invention and showing it placed within a sewage treatment basin.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring more in detail to the drawings:

The reference numeral 1 generally indicates a mixing aerator embodying the present invention. In overview, the aerator 1 generally depends from a basin wall extending along a portion of a sewage treatment tank of a similar liquid treatment facility. The aerator 1 includes an upright beam member or mast 4 supported near the top and bottom ends, and which extends into a body of liquid along the basin wall 2. A submersible propulsion unit 5 is mounted on the mast 4 to create a mixing flow or current within the body of liquid.

In the illustrated example, the mast 4 is of square beam construction with opposite side walls 7 and 8 and front and rear walls 9 and 10, although it is within the concept of this invention that the mast may also be of tubular construction. The mast 4 has opposite upper end and bottom end portions 12 and 13 with the upper end portion 12 extending above the surface of the liquid being treated. Pivot means are located at the upper and bottom end portions 12 and 13 and enable rotation about the longitudinal axis of the mast 4 for adjusting the azimuth of the direction of thrust of the propulsion unit 5.

For the lower pivot means, a ball pivot 15 is preferably employed which includes a base plate 17 mounted upon the sewage treatment tank bottom wall 18. The mast 4 at its upper end 12 is held in position by support means including an anchor post 20 secured to the top of the basin wall 2 and with a telescoping support arm 21 extending outwardly thereof. An azimuth lock means 23 is secured to the outer end of the telescoping support arm 21 and extends about the mast 4, as described below. A tiller 24 is situated for grasping and rotating the mast 4 and the propulsion unit 5 connected thereto.

The propulsion unit 5 is mounted to the mast 4 and includes a bracket 26 such as formed of opposite side plates 28 and 29, rear connecting bars, 31, FIG. 8, and a front web plate 32 which extend about the mast 4. The bracket 26 provides a motor mount for a submersible motor 34 which drives a propeller 36. Normally, a gear reduction unit 37 is mounted between the motor 34 and the propeller 36. The motor 34 may be either electric, as disclosed in our U.S. Pat. No. 4,431,597, or hydraulic, as disclosed in our U.S. Pat. No. 4,464,259.

The propulsion unit 5 raises and lowers on the mast 4 by means of a cable 39 and winch assembly 40 which may be either electrically or hand powered and is operable to draw the propulsion unit upwardly for servicing. Preferably, the rear connecting bars 31 of the bracket 26 are easily removable for swinging the entire propulsion unit 5 from the mast 4 for ease of servicing.

Figure 6:
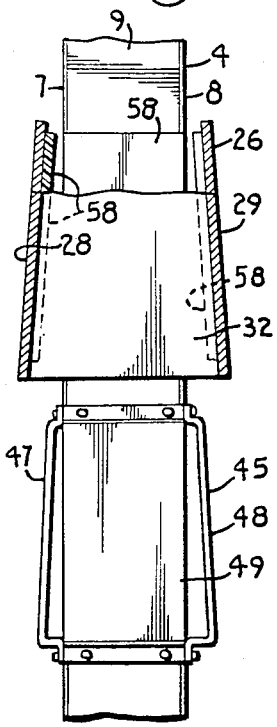
FIG. 6 is a sectional view taken along lines 6—6 of FIG. 2, and showing parts in a disengaged relationship.

As part of the present invention, the mixing aerator 1 includes a bottom stop 45, particularly as shown in FIGS. 6, 7, and 8. In the illustrated example, the bottom stop 45 includes spaced, inclined side braces 47 and 48 and a front plate 49, each of which are composed of upper and lower flanges 51 and 52, FIG. 7, and upper and lower step portions 53 and 54. The lower step 54 is wider than the upper step 53 so as to angle or incline the face of the side plate 47, 48 or 49 upwardly, FIG. 7. The side plates 47, 48 and 49 are held in position by bolts 56 extending through the flanges 51 and 52 and into the mast 4. The height of the position of the plates 47, 48 and 49 is set after consideration of the desired mixing level within the body of liquid and the clearance of the propeller 36. In conjunction with the plates 47, 48 and 49, the bottom stop 45 includes the side plates 28 and 29 and the front web plate 32 of the propulsion unit bracket 26. These, too, are angled or inclined upwardly, FIGS. 7 and 8, in an angular relationship to match the angle of the side plates 47, 48 and 49.

Mounted between the side plates 28, 29 and the front web plate 32 of the bracket 26 and the side plates 47 and 48 and front plate 49 are vibration dampening pads 58, such as formed of a synthetic rubber material such as neoprene. In the illustrated example, the dampening pads 58 are secured, as by gluing, to the bracket side plates 28 and 29 and the front web plate 32, although it is within the concept of this invention that these dampening pads could likewise be secured to the faces of the side plates 47, 48 and the front plate 49. To adhere the dampening pads 58 to the plates, which are preferably of metal, various commercially available adhesives are suitable, including those using a vulcanizing process.

Also serving to dampen the vibration, the rear connecting bars 31 may be fitted with rollers or wheels 59, also composed of a vibration dampening material in an attempt to isolate the propulsion unit 5 from the mast 4.

The upper azimuth lock means 23 is also a significant element of the present invention. It is designed to securely clamp the mast 4 and propulsion unit 5 in a selected degree of azimuth and to attempt to isolate or dampen as much as possible the upper mount for the mast 4 from vibration passed from the propulsion unit 5 through the bottom stop 45 and into the mast 4.

In the illustrated example, the azimuth lock means 23 includes a circular clamp ring 61, FIGS. 3 and 4, such as formed of a length of cylindrical pipe slit longitudinally to open and having edges each with confronting flanges 63 secured together and tensionable by bolts 64. The clamp ring 61 extends about the mast 4 and disposed therebetween are a plurality of leaves 66, FIG. 5. Each leaf 66 has a flat rear face 67 and a curved front face 68, the curvature of which is designed to match the radius of curvature of the clamp ring 61. Each leaf 66 is of a length to nest within the clamp ring 61 and has a top flange 70 which is positioned upon the upper periphery of the clamp ring 61 and holds the leaf 66 in place. A bottom flange 71 extends in an opposite direction to the top flange 70 and cradles a vibration dampening pad 72 on the leaf 66. The pad 72 is preferably of the same material as the pad 58 and is bonded to the leaf 66 in a like manner. The width of each leaf 66 is preferably the same as the width of each of the walls 7 through 10 and is designed for face to face engagement and maximum vibration dampening therebetween.

Preferably, each of the leaves 66 fits the curved front face 68 thereof with friction enhancing elements for substantial frictional engagement between the leaves 66 and the inner surface of the clamp ring 61. In the illustrated example, small granular bits of a sharp material such as silicon carbide 74 are peppered in the face 68 and implaced in the metal matrix during a casting process. For example, the leaf 66 may be formed of a matrix of cast aluminum, steel or pot metal and the silicon carbide grains are poured into the mold cavity, with the front face 68 meeting the bottom of the mold cavity, prior to pouring the molten metal into the mold. In use, the silicon carbide fragments 74 tend to bite into the surface of the clamp ring 61 and provide significant frictional engagement for interlocking of the parts.

Although the granular bits, such as the silicon carbide 74, are intended to frictionally lock the mast 4 against rotation when the clamp ring 61 are tightened, in some situations, a more positive locking means may be required.

Referring to FIGS. 3 and 4, the leaf 66 positioned facing the mast front wall 9 has several bolt holes 76 extending through its top flange 70, including in the illustrated example, a center hole and spaced side holes. These holes 76 correspond to bored ears 77 mounted adjacent the upper edge of the front of the clamp ring 61 whereby screws 78 may be passed through the holes 76 and into the bores in the ears 77 for positive azimuth engagement between the clamp ring 61 and the leaf 66.

In the employment of both the azimuth lock means 23 and the bottom stop 45, substantial vibration dampening is accomplished by the pads 58 and 72. These tend to isolate the upper and lower mounting areas of the mast 4, including the ball pivot 15 and base plate 17 and the anchor post 20, from the vibrations and torque transients of the propulsion unit 5. The inclined surfaces of the bottom stop 45 provide a wedge effect for a snug inter-engagement between the propulsion unit 5 and the mast 4, but yet the dampening pads 58 therebetween dampen fatigue inducing vibration.

Particularly with large propellers 36, there has been a tendency for prior mixing aerators to deviate from a set azimuth due to the tremendous torque generated by such a propeller. The disclosed azimuth lock means 23 substantially reduces the tendency to depart from the set azimuth by more positive locking between the lock elements, including the dampening pads 72 and the leaves 66 and the clamp ring 61. The engagement enhancing silicon carbide elements 74 encourage tight, gripping engagement and the dampening pads 72 tend to reduce vibrations which would otherwise cause a working loose of the parts in metal to metal engagement. These elements provide significant locking and vibration mechanisms which enable longer life and more satisfactory operation of the mixing aerator 1. The locking screws 78 may also be screwed through the leaf flange 70 and into the ears 77 for positive engagement and azimuth lock.

It is to be understood that while certain forms of the present invention have been illustrated and described herein, it is not to be limited to the specific forms or arrangement of parts described and shown.

What is claimed and desired to be secured by Letters Patent is as follows:

1. A liquid circulating apparatus comprising:

(a) an upright beam member for extending into a body of liquid;

(b) upper and lower support means for holding said beam member in said body;

(c) a bracket mounted on said beam member and including spaced sidewalls and an endwall;

(d) a submersible motor mounted on said bracket and extending outwardly of said endwall;

(e) a propulsion means operably connected to and rotatably powered by said motor to effect an outwardly directed flow in said body of liquid;

(f) lift means to raise and lower said bracket, with said motor and propulsion means attached thereto, in said beam member;

(g) a bottom stop on said beam member for stopping said bracket at a desired downward position, and including a plurality of plates mounted angularly on said beam member and converging upwardly in a wedge formation;

(h) said bracket spaced sidewalls and said endwall being angled outwardly about said beam member and mateable with said bottom stop;

(i) rubber, vibration dampening pads interposed between said bottom stop plates and said bracket sidewalls and endwall;

(j) an azimuth lock extending between said upper support means and said beam member at an upper end thereof; said azimuth lock including a clamp ring tightenable about said beam member, for setting a selected azimuth of said propulsion means, a plurality of lock segments insertable between said clamp ring and said beam member, rubber vibration dampening pads interposed between said lock segments and said beam member, and said lock segments having a roughened surface texture for frictional engagement with said clamp ring.

2. A liquid circulating apparatus comprising:

(a) an upright beam member for extending into a body of liquid;

(b) upper and lower support means for holding said beam member in said body;

(c) a bracket mounted on said beam member;

(d) a submersible motor mounted on said bracket and extending outwardly therefrom;

(e) a propulsion means operably connected to said motor to effect an outwardly directed flow in said body of liquid;

(f) said beam member being rotatable relative to said upper and lower support means for adjusting the azimuth of flow from said propulsion means;

(g) an azimuth lock positioned between said upper support means and said beam member and including a clamp ring tightenable about said beam member for setting a selected azimuth of said propulsion means and a plurality of lock segments positioned between said clamp ring and said beam member; and (h) said lock segment having a roughened surface texture for frictional engagment with said clamp ring.

3. The liquid circulating apparatus set forth in claim 2 wherein:

(a) said surface texture is caused by granular bits of hard material.

4. A liquid circulating apparatus set forth in claim 3 wherein:

(a) said bits are silicon carbide.

5. The liquid circulating apparatus comprising:

(a) an upright beam member for extending into a body of liquid;

(b) upper and lower support means for holding said beam member in said body;

(c) a bracket mounted on said beam member;

(d) a submersible motor mounted on said bracket and extending outwardly therefrom;

(e) a propulsion means operably connected to said motor to effect an outwardly directed flow in said body of liquid;

(f) lift means to raise and lower said bracket, with said motor and propulsion means attached thereto, on said beam member;

(g) said beam member being rotatable relative to said upper and lower support means for adjusting the azimuth of flow from said propulsion means;

(h) an azimuth lock positioned between said upper support means and said beam member and including a clamp ring tightenable about said beam member for setting a selected azimuth of said propulsion means, a plurality of lock segments positioned between said clamp ring and said beam member, rubber vibration dampening pads interposed between said lock segments and said beam member, and said lock segments having a roughened surface texture for frictional engagement with said clamp ring.

6. The liquid circulating apparatus set forth in claim 5 wherein:

(a) said lock segments are composed of a material including small fragments of hard, granular material set in a matrix.

7. The liquid circulating apparatus set forth in claim 6 wherein:

(a) said granular material is silicon carbide; and (b) said matrix is a base metal.

8. The liquid circulating apparatus set forth in claim 5 wherein:

(a) said beam member is a square beam with four faces;

(b) said clamp ring are substantially circular;

(c) said lock segments are four in number and fit against the faces of said beam member.

9. The liquid circulating apparatus set forth in claim 8 including:

(a) screw locking means extending between said clamp ring and said lock segments and including bored ears on said clamp ring and bores on one of said lock segments for passage of a threaded fastener therebetween.

10. A liquid circulating apparatus comprising:

(a) an upright beam member for extending into a body of liquid;

(b) upper and lower support means for holding said beam member in said body;

(c) a bracket mounted on said beam member and including spaced sidewalls and an endwall;

(d) a submersible motor mounted on said bracket and extending outwardly of said endwall;

(e) a propulsion means operably connected to and rotatably powered by said motor to effect an outwardly directed flow in said body of liquid;

(f) lift means to raise and lower said bracket, with said motor and propulsion means attached thereto, on said beam member;

(g) a bottom stop on said beam member for stopping said bracket at a desired downward position, and including a plurality of plates mounted angularly on said beam member and converging upwardly in a wedge formation;

(h) said bracket spaced sidewalls and endwall being angled outwardly about said beam member and mateable with said bottom stop; and (i) rubber, vibration dampening pads interposed between said bottom stop plates and said bracket sidewalls and endwall.

11. The liquid circulating apparatus set forth in claim 10 wherein:

(a) said beam member is a square beam having four faces and said bottom stop plates are mounted on at least three of said faces.

12. The liquid circulating apparatus set forth in claim 10 wherein:

(a) said pads are secured to said bracket sidewalls and endwall.

13. A liquid circulating apparatus comprising:

(a) an upright beam member for extending into a body of liquid;

(b) upper and lower support means for holding said beam member in said body;

(c) a bracket mounted on said beam member and including spaced wall means;

(d) a submersible motor mounted on said bracket and extending outwardly of said wall means;

(e) a propulsion means operably connected to and rotatably powered by said motor to effect an outwardly directed flow in said body of liquid;

(f) lift means to raise and lower said bracket, with said motor and propulsion means attached thereto, on said beam member;

(g) a bottom stop on said beam member for stopping said bracket at a desired downward position, and including plate means mounted angularly on said beam member and tapering upwardly in a wedge formation; and (h) said bracket wall means extending about said beam member and angling upwardly to mate with said plate means of said bottom stop.

14. The liquid circulating apparatus set forth in claim 13 including:

(a) rubber, vibration dampening pads interposed between said bottom stop plate means and said bracket wall means.

* * * * *